US009925562B2

(12) United States Patent
Oh et al.

(10) Patent No.: US 9,925,562 B2
(45) Date of Patent: Mar. 27, 2018

(54) VIBRATOR

(71) Applicant: SAMSUNG ELECTRO-MECHANICS CO., LTD., Suwon-si (KR)

(72) Inventors: Hwa Young Oh, Suwon-si (KR); Seung Hyeon Jeong, Suwon-si (KR)

(73) Assignee: MPLUS CO., LTD., Suwon-si, Gyeonggi-Do (KR)

( * ) Notice: Subject to any disclaimer, the term of this patent is extended or adjusted under 35 U.S.C. 154(b) by 507 days.

(21) Appl. No.: 14/601,243

(22) Filed: Jan. 21, 2015

(65) Prior Publication Data

US 2015/0266060 A1 Sep. 24, 2015

(30) Foreign Application Priority Data

Mar. 19, 2014 (KR) ..... 10-2014-0032196

(51) Int. Cl.
*B06B 1/06* (2006.01)

(52) U.S. Cl.
CPC ..... *B06B 1/0603* (2013.01)

(58) Field of Classification Search
CPC ... H01L 41/053; H01L 41/08; H01L 41/0835; H01L 41/092
USPC ..... 310/328, 329, 345, 348, 351, 355
See application file for complete search history.

(56) References Cited

U.S. PATENT DOCUMENTS

2012/0248935 A1* 10/2012 Liu ..... H01L 41/0933 310/326
2014/0055006 A1 2/2014 Oh et al.
2014/0070667 A1* 3/2014 Oh ..... B06B 1/0644 310/326

FOREIGN PATENT DOCUMENTS

| | | | |
|---|---|---|---|
| JP | 11074580 | A | 3/1999 |
| JP | 2001-17917 | A | 1/2001 |
| JP | 2011-206634 | A | 10/2011 |
| KR | 10-2006-0000894 | A | 1/2006 |
| KR | 10-0728373 | | 6/2007 |
| KR | 101241030 | B1 | 3/2013 |
| KR | 10-2014-0027625 | | 3/2014 |

OTHER PUBLICATIONS

Machine translation of KR 10-1241030 provided by the website of the European Patent Office.*
KIPO Office Action for Korean Application No. 10-2014-0032196 which corresponds to the above-referenced U.S. application.
SIPO Office Action for Chinese Patent Application No. 201510063718.X which corresponds to the above-referenced U.S. application.
Office Action dated Oct. 8, 2015 for Korean Patent Application No. 10-2014-0032196 and its English summary provided by Applicant's foreign counsel.

* cited by examiner

*Primary Examiner* — Derek Rosenau
(74) *Attorney, Agent, or Firm* — LRK Patent Law Firm

(57) ABSTRACT

A vibrator includes a piezoelectric element deformed when power is applied thereto, an installation member having the piezoelectric element installed thereon, and a plurality of elastic members connected to the installation member and changing a displacement direction through deformation of the installation member. The plurality of elastic members are disposed to oppose each other.

17 Claims, 8 Drawing Sheets

VIBRATOR

CROSS-REFERENCE TO RELATED APPLICATION

This application claims the priority and benefit of Korean Patent Application No. 10-2014-0032196 filed on Mar. 19, 2014, with the Korean Intellectual Property Office, the disclosure of which is incorporated in its entirety herein by reference.

BACKGROUND

The present disclosure relates to a vibrator.

A vibrator, a component converting electrical energy into mechanical vibrations using the principle of the generation of electromagnetic force, is mounted in a mobile phone or the like to silently notify a user of call reception by transferring vibrations thereto.

Meanwhile, in accordance with the rapid growth in the mobile phone market and the trend toward the addition of functionality to mobile phones, mobile phone components have been required to be miniaturized and to have high quality. In this situation, the demand for the development of the vibrators having a new structure capable of overcoming the disadvantages of existing vibrators and having significantly improved quality has increased.

In addition, as the release of smartphones, among mobile phones, has rapidly increased, a touchscreen scheme has been adopted for use therewith, such that vibrators have been increasingly used in order to generate vibrations at the time of a touch interaction with a touchscreen.

Levels of performance required in the vibrations generated at the time of touching the touchscreen are as follows. First, since the number of vibrations generated at the time of touching the touchscreen is greater than that of vibrations generated at the time of call reception, an operation lifespan should be increased. Secondly, in order to increase user satisfaction when a user encounters vibrations at the time of touching the touchscreen, a response speed of the vibrations should be increased in accordance with a touch speed of the touchscreen.

In addition, a piezo haptic actuator has been used as products capable of implementing such levels of performance. Such a piezo haptic actuator uses a principle of an inverse piezoelectric effect by which displacement is generated when a voltage is applied to a piezoelectric element, for example, a principle of allowing a weight of a mover to be moved by the generated displacement to generate vibrational force.

A vibrator having the above-mentioned structure has the following features. A bandwidth of a frequency capable of obtaining a predetermined level or more of vibrational force is wide, such that stable vibration characteristics may be implemented, and vibrations having low and high frequencies rather than a single frequency in a predetermined frequency range may be variously used. In addition, since the vibrator may implement rapid operation response characteristics, it may be appropriate for implementing haptic vibrations of a mobile device such as a mobile phone, or the like.

Meanwhile, the piezoelectric element generally has a rectangular parallelepiped shape in which a length thereof is greater than a width thereof. In this case, since the length of the piezoelectric element should be relatively long in order to secure displacement and vibrations, an overall length of the vibrator may be increased and the piezoelectric element may be vulnerable to impacts due to being dropped.

Further, since the overall shape of the vibrator is a rectangular parallelepiped, the entire volume thereof is increased, such that it is not appropriate for miniaturization of components.

RELATED ART DOCUMENT

Korean Patent Laid-Open Publication No. 2006-0000894

SUMMARY

An aspect of the present disclosure may provide a vibrator having a piezoelectric element having a coin shape capable of increasing an amount of vibration.

According to an aspect of the present disclosure, a vibrator may include a piezoelectric element deformed when power is applied thereto, an installation member having the piezoelectric element installed thereon, and a plurality of elastic members connected to the installation member and changing a displacement direction through deformation of the installation member. The plurality of elastic members may be disposed to oppose each other.

The vibrator may further include a housing having the elastic members installed therein and an internal space.

The vibrator may further include a mass body installed on the elastic member to increase vibrations generated through deformation of the piezoelectric element.

The vibrator may further include a damper member installed in at least one of the housing and the installation member to prevent the occurrence of noise and damage due to collisions.

The housing may include a case having an internal space and an open lower end portion, and a bracket coupled to the lower end portion of the case to form an enclosed space.

The elastic member may include a first elastic member installed on the bracket and a second elastic member installed on the first elastic member to generate vibrations by the first and second elastic members.

The first and second elastic members may include an outer ring portion having a ring form having a wave form, a plurality of connecting parts extended inwardly from an inner edge of the outer ring portion in a radial direction, and a bonding portion extended from an inner edge of the outer ring portion to be disposed between an inner ring portion connected to the plurality of connecting parts and having a ring form and the connecting parts.

The first and second elastic members may be coupled to each other at the bonding portion and may disposed to be significantly spaced apart from each other at the connecting parts.

The bonding portions may be formed to have an angle of 120° with respect to each other.

The installation member may include a circular plate portion, a displacement direction changing part extended downwardly from the plate portion, and a fixing part extended inwardly from the displacement direction changing part in a radial direction and bonded to the elastic member.

The vibrator may further include a frequency adjusting member installed on the installation member. The frequency adjusting member may include a ring-shaped body part having a ring form and bonded to a top surface of the plate portion and a reinforcing portion extended from the ring-shaped body part to correspond to a position of the displacement direction changing part.

According to another aspect of the present disclosure, a vibrator may include a housing containing an internal space, a plurality of elastic members installed in the housing and disposed to oppose each other, an installation member connected to the elastic members and changing a displacement direction in conjunction with the elastic members, a piezoelectric element fixedly installed on the installation member and deformed when power is applied thereto, and a mass body installed on the elastic members to be disposed below the piezoelectric element.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
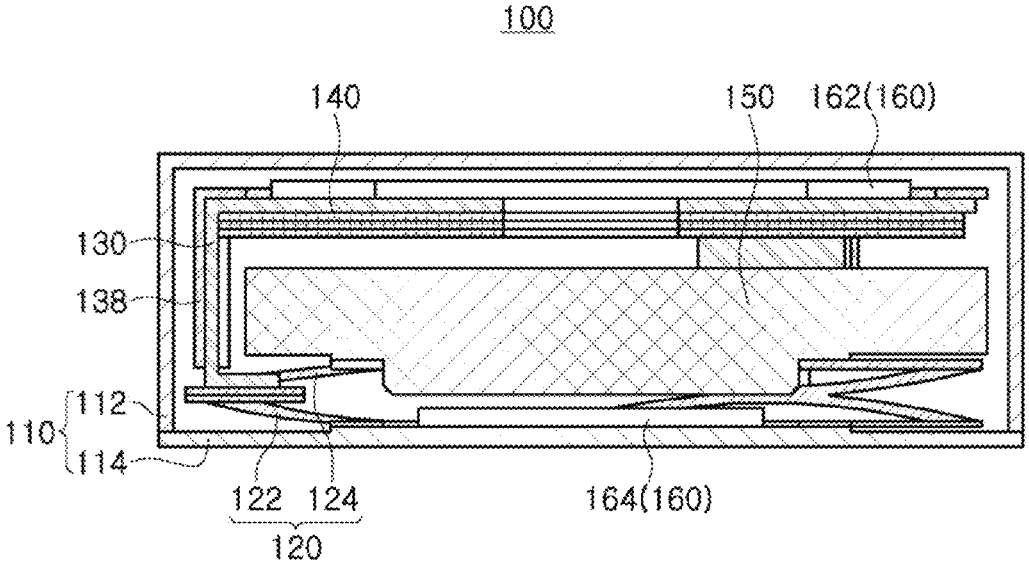
FIG. 1 is a schematic cross-sectional view illustrating a vibrator according to an exemplary embodiment of the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
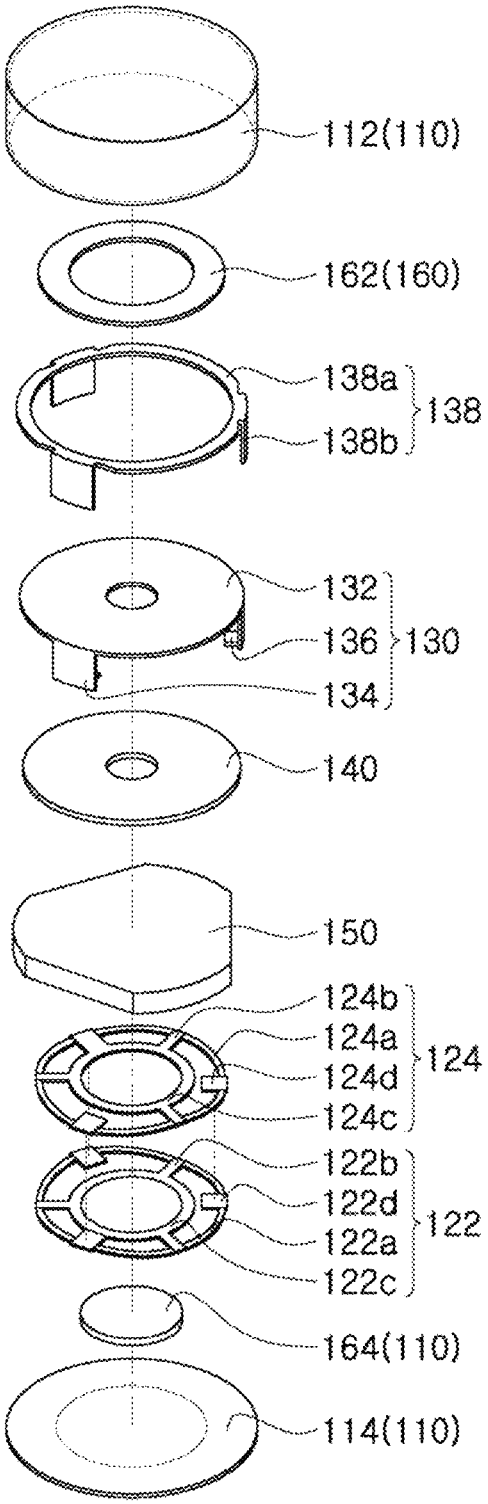
FIG. 2 is an exploded perspective view illustrating the vibrator according to an exemplary embodiment of the present disclosure.
Figure 3:
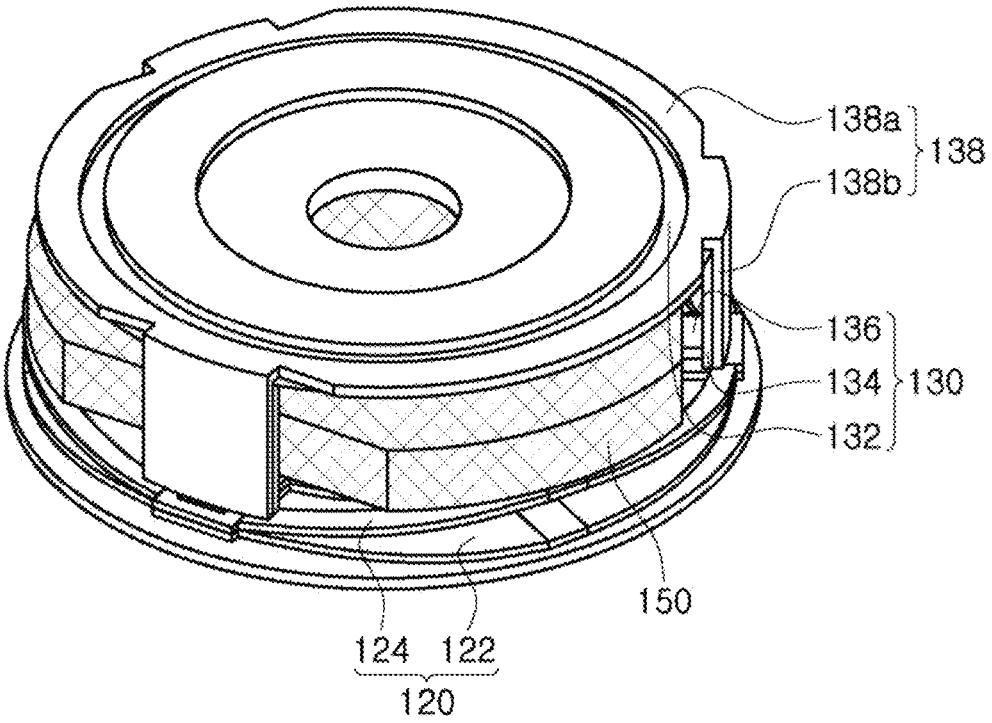
FIG. 3 is a view illustrating an internal structure of the vibrator according to an exemplary embodiment of the present disclosure.
Figure 4:
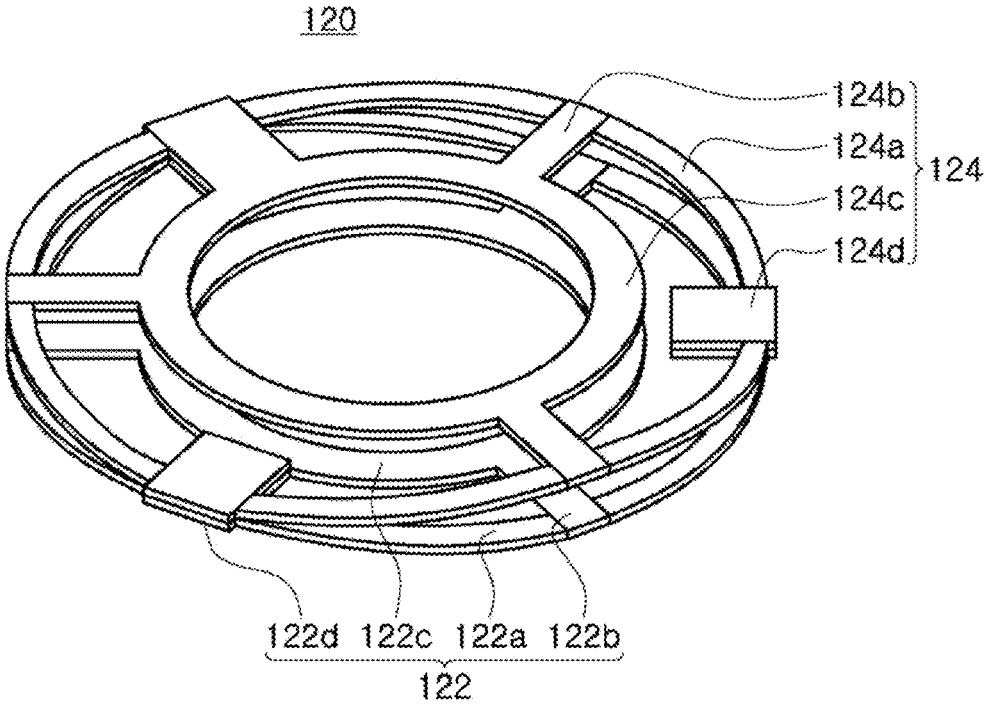
FIG. 4 is a perspective view illustrating an elastic member of the vibrator according to an exemplary embodiment of the present disclosure.
Figure 5:
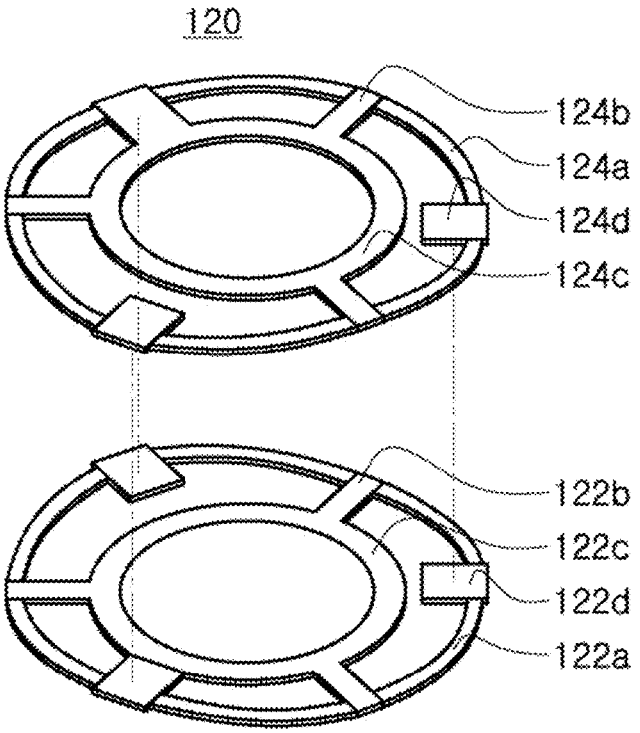
FIG. 5 is an exploded perspective view illustrating the elastic member of the vibrator according to an exemplary embodiment of the present disclosure.

FIG. 1 is a schematic cross-sectional view illustrating a vibrator according to an exemplary embodiment of the present disclosure, FIG. 2 is an exploded perspective view illustrating the vibrator according to an exemplary embodiment of the present disclosure, FIG. 3 is a view illustrating an internal structure of the vibrator according to an exemplary embodiment of the present disclosure, FIG. 4 is a perspective view illustrating an elastic member of the vibrator according to an exemplary embodiment of the present disclosure, and FIG. 5 is an exploded perspective view illustrating the elastic member of the vibrator according to an exemplary embodiment of the present disclosure.

Referring to FIGS. 1 through 5, a vibrator 100 according to an exemplary embodiment of the present disclosure may include a housing 110, an elastic member 120, an installation member 130, a piezoelectric element 140, a mass body 150, and a damper member 160, by way of example.

The housing 110 may have the elastic member 120 installed therein and an internal space therein and may form an appearance of the vibrator 100.

Meanwhile, the housing 110 may include a case 112 having an internal space and an open lower end portion, and a bracket 114 which is coupled to the lower end portion of the case 112 to form a closed space, as illustrated in more detail in FIG. 2.

As an example, the case 112 may have a circular flat cylindrical shape in which the lower end portion thereof is open and the bracket 114 may have a plate shape and may be coupled to the case 112.

As such, the elastic member 120, the installation member 130, the piezoelectric element 140, the mass body 150, and the damper member 160 as mentioned above may be installed in the housing having the internal space.

The elastic member 120 may be connected to the installation member 130 to change a displacement direction through deformation of the installation member 130 and a plurality of elastic members 120 may be provided. In addition, the elastic members 120 may be installed in the housing 110 and may be disposed to oppose each other.

The elastic member 120 will be described in more detail. As illustrated in more detail in FIGS. 4 and 5, the elastic member 120 may include a first elastic member 122 installed on the bracket 114 and a second elastic member 124 installed on the first elastic member 122 to generate vibrations by the first and second elastic members 122 and 124.

Meanwhile, the first and second elastic members 122 and 124 have the same shape and the same configuration except that directions of wave forms of outer ring portions 122*a* and 124*a* are opposite to each other. Therefore, hereinafter, the first elastic member 122 will only be described in more detail and a description of the second elastic member 124 will be replaced by the description of the first elastic member 122.

The first elastic member 122 may include an outer ring portion 122*a*, a connecting part 122*b*, an inner ring portion 122*c*, and a bonding portion 122*d*.

The outer ring portion 122*a* may have a ring form having a wave form. As an example, the outer ring portion 122*a* may be evenly formed so as to be in parallel to the bracket 114 in a region thereof corresponding to the bonding portion 122*d* and may be formed so as to have a curvature in a region thereof corresponding to the connecting part 122*b*.

Meanwhile, the outer ring portion 122*a* may be bonded to the bracket 114, so that a region thereof corresponding to the connecting part 122*b* may be fixedly installed on the bracket 114.

A plurality of connecting parts 122*b* may be extended inwardly from an inner edge of the outer ring portion 122*a* in a radial direction. In addition, the connecting parts 122*b* may be disposed so as to be spaced apart from each other at an angle of 120° with respect to each other by way of example. For example, three connecting parts 122*b* may be extended from portions of an inner edge of the outer ring portion 122*a*.

Here, terms with respect to directions will be described. As viewed in FIG. 1, a radial direction refers to a horizontal direction, for example, a direction from an outer peripheral surface of the housing 110 to a center thereof or a direction from the center of the housing 110 to the outer peripheral surface thereof, and a vertical direction refers to a direction from a bottom surface of the housing 110 to a top surface thereof or a direction from the top surface of the housing 110 to the bottom surface thereof.

In addition, a circumferential direction refers to a rotation direction along an outer peripheral surface of the housing 110.

An inner ring portion 122*c* may be connected to the connecting part 122*b* and have a ring form. Meanwhile, the inner ring portion 122*c* may have a diameter smaller than that of the outer ring portion 122*a* and may be evenly formed. In other words, the inner ring portion 122*c* may have the ring form which does not have the wave form.

For example, the inner ring portion 122*d* may be connected to the outer ring portion 122*a* through the connecting parts 122*b*.

The bonding portion 122*d* may be formed to be extended from an inner edge of the outer ring portion 122*a*, inwardly in the radial direction, so as to be disposed between the connecting parts 122*b*. As an example, the bonding portions 122*d* may also be disposed so as to be spaced apart from each other at an angle of 120° with respect to each other, similar to the case of the connecting parts 122*b*. For example, three bonding portions 122*d* may be formed to be extended from portions of an inner edge of the outer ring portion 122*a*.

Meanwhile, the second elastic member 124 may also include an outer ring portion 124*a*, a connecting part 124*b*, an inner ring portion 124*c*, and a bonding portion 124*d*, similar to the configuration of the first elastic member 122.

Here, a method of coupling the first and second elastic members 122 and 124 will be described. The first and second elastic members 122 and 124 may be disposed so that the bonding portions 122*d* and 124*d* thereof are bonded to each other and may be disposed to be significantly spaced apart from each other in regions thereof in which the connecting parts 122*b* and 124*b* of the outer ring portions 122*a* and 124*a* are formed. For example, the outer ring portions 122*a* and 124*a* of the first and second elastic members 122 and 124 may have a ring form having a wave form. Portions having the curvature among the outer ring portions 122*a* and 124*a* may be disposed so as to be spaced apart from each other, and portions evenly formed in the outer ring portions 122*a* and 124*a* may be in contact with each other.

Meanwhile, the first and second elastic members 122 and 124 coupled to each other as described above may be vibrated while being in contact with each other or being significantly spaced apart from each other in the regions in which the connecting parts 122*b* and 124*b* of the outer ring portions 122*a* and 124*a* are formed, at the time of generation of vibrations.

A detailed description thereof will be provided below.

The piezoelectric element 140 may be installed on the installation member 130. In addition, the installation member 130 may be connected to the elastic member 120 and serve to change a displacement direction in conjunction with the elastic member 120.

To this end, the installation member 130 may include a plate portion 132, a displacement direction changing part 134, and a fixing part 136.

The plate portion 132 may have a circular plate shape and may be formed to have a diameter larger than that of the piezoelectric element 140. In addition, the center of the plate portion 132 may be provided with a hole formed therein, allowing for a flow of air, at the time of the generation of vibrations.

In addition, the displacement direction changing part 134 may be formed to be extended from an edge of the plate portion 132 to a lower side and a plurality of displacement direction changing parts 132 may be formed so as to be spaced apart from each other in the circumferential direction. As an example, the displacement direction changing parts 134 may be disposed so as to be spaced apart from each other while having an angle of 120° with respect to each other.

In addition, the fixing part 136 may be extended from the displacement direction changing part 134 inwardly in the radial direction and may be bonded to the elastic member 120. As an example, the fixing member 136 may be bonded to the bonding portion 124*d* of the second elastic member 124.

Meanwhile, operations of the installation member 130 will be briefly described. A lower end portion of the displacement direction changing part 134 of the installation member 130 may be moved in the radial direction through deformation of the piezoelectric element 140. For example, in the case in which the central portion of the piezoelectric element 140 is deformed so as to have a concave shape, the lower end portion of the displacement direction changing part 134 of the installation member 130 may be moved outwardly in the radial direction. In addition, in the case in which the piezoelectric element 140 is deformed so that the central portion of the piezoelectric element 140 has a convex shape, the displacement direction changing part 134 of the installation member 130 may be moved inwardly in the radial direction.

Therefore, the bonding portion 124*d* of the second elastic member 124, to which the fixing part 136 is bonded and installed, and the bonding portion 122*d* of the first elastic member 122 bonded to the bonding portion 124*d*, may be moved vertically.

Meanwhile, a frequency adjusting member 138 may be installed on the installation member 130. The frequency adjusting member 138 may have a ring-shaped body part 138*a* having a ring form and bonded to a top surface of the plate portion 132 and a reinforcing portion 138*b* formed to be extended from the ring-shaped body part 138*a* so as to correspond to a position of the displacement direction changing part 134.

However, although the exemplary embodiment of the present disclosure describes a case in which the frequency adjusting member 138 is installed on the installation member 130 by way of example, exemplary embodiments in the present disclosure are not limited thereto. The frequency adjusting member 138 may not be installed on the installation member 130, and in this case, the installation member 130 may be formed to have a relatively thick thickness.

The piezoelectric element 140 may be fixedly installed on the installation member 130. As an example, the piezoelectric element 140 may be fixedly installed on a bottom surface of the plate portion 132. Meanwhile, the piezoelectric element 140 may have a circular plate shape and may have a diameter smaller than that of the plate portion 132. In addition, the central portion of the piezoelectric element 140 may also be provided with a hole formed therein in order to allow for a smooth flow of air at the time of generation of deformation.

In addition, in the case in which power is applied to the piezoelectric element 140, the central portion of the piezoelectric element 140 may be deformed to become concave or convex.

Meanwhile, although not illustrated in the drawings, the piezoelectric element 140 may be connected to a substrate so that power may be applied to the piezoelectric element 140.

The mass body 150 may be installed on the elastic member 120 to serve to amplify vibrations generated due to the deformation of the piezoelectric element 140. As an example, the mass body 150 may be seated on a top surface of the second elastic member 124 to be bonded thereto.

In addition, the mass body 150 may be formed to have a step, and a lower end portion of the mass body may be disposed to be inserted into the inner ring portion 124*c*. Meanwhile, the mass body 150 may be formed of a material having a high specific gravity in order to amplify vibrations, and may be formed of a material such as tungsten or iron byway of example.

In other words, in order to increase an amount of vibration by adjusting a resonance frequency through an increase in mass in the same volume, the mass body 150 may be formed of a material having a high specific gravity.

The damper member 160 may be installed on at least one of the housing 110 and the installation member 130 to serve to prevent the occurrence of noise or damage due to collisions. Meanwhile, the damper member 160 may include a first damper 162 installed on the top surface of the plate portion 132 of the installation member 130 and a second damper 164 installed on the top surface of the bracket 114.

The first damper 162 may serve to prevent noise and damage occurring when the installation member 130 and the case 112 are in contact with each other at the time of vibrating, and the second damper 164 may serve to prevent noise and damage occurring when the mass body 150 and the bracket 114 are in contact with each other.

To this end, the first and second dampers 162 and 164 may be formed of an elastic material.

As described above, since the vibration may be amplified by the plurality of elastic members 120, for example, the first and second elastic members 122 and 124, a vibration amount may be increased.

In addition, since the piezoelectric element 140 is configured as an oscillator which is vibrated together with the installation member 130, the elastic member 120 and the installation member 130 may absorb an impact applied externally at the time of occurrence of an external impact. Therefore, the damage to the piezoelectric element 140 may be reduced.

Hereinafter, operations of the vibrator according to an exemplary embodiment of the present disclosure will be briefly described with reference to the accompanying drawings.

Figure 6:
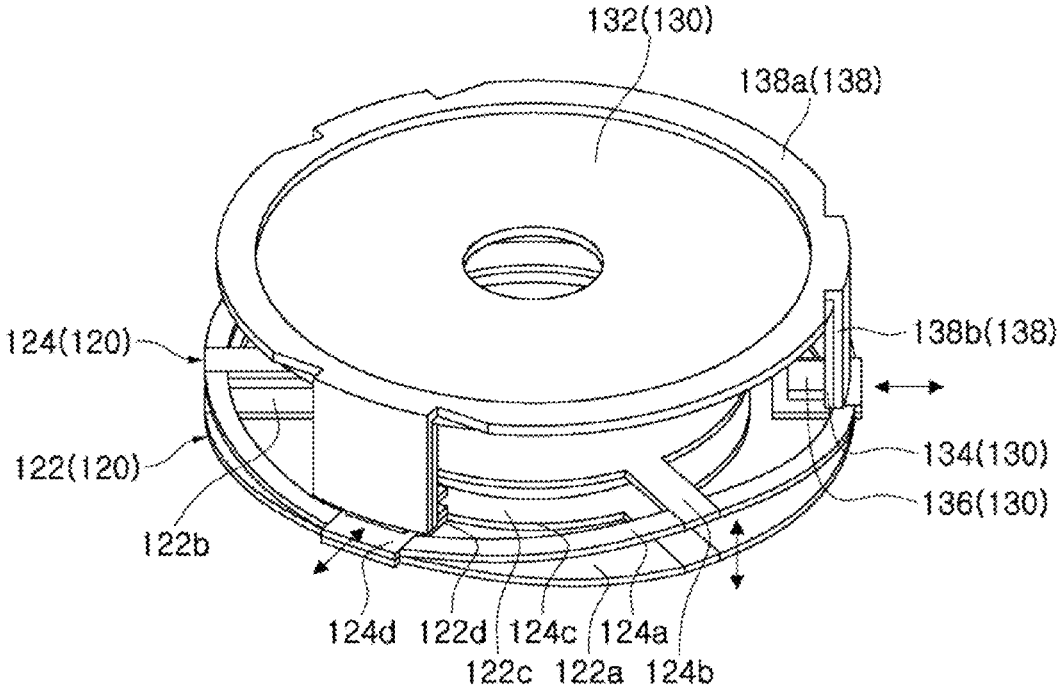
FIG. 6 is a view illustrating an operation by an installation member and the elastic member of the vibrator according to an exemplary embodiment of the present disclosure.
Figure 7:
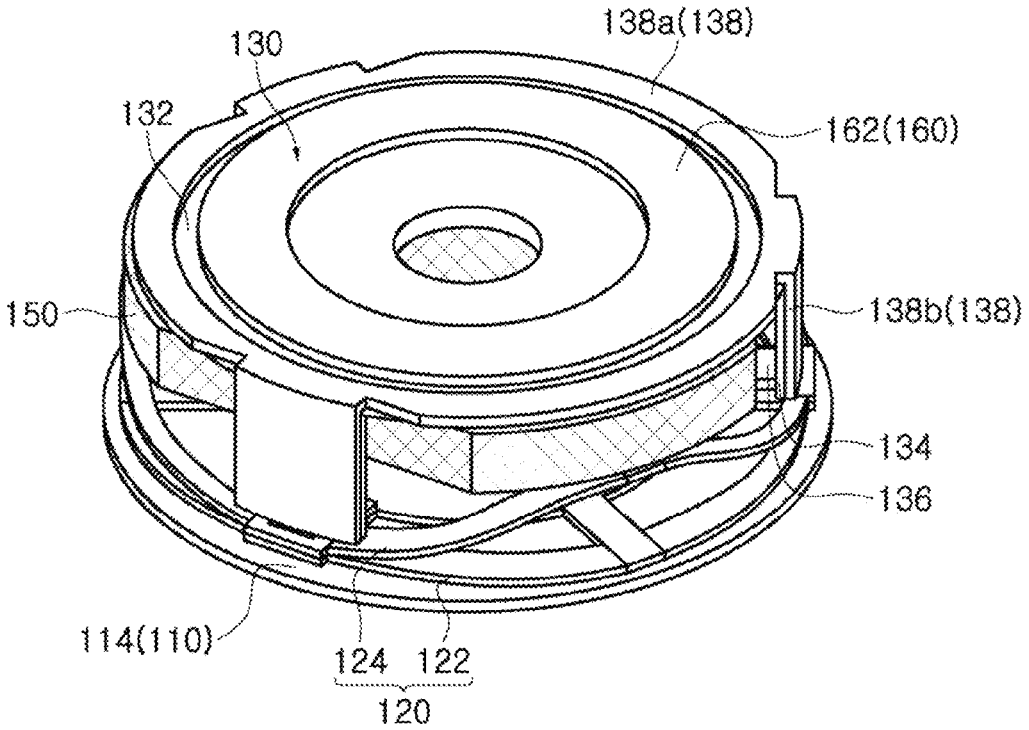
FIGS. 7 and 8 are views illustrating an operation of the vibrator according to an exemplary embodiment of the present disclosure.
Figure 8:
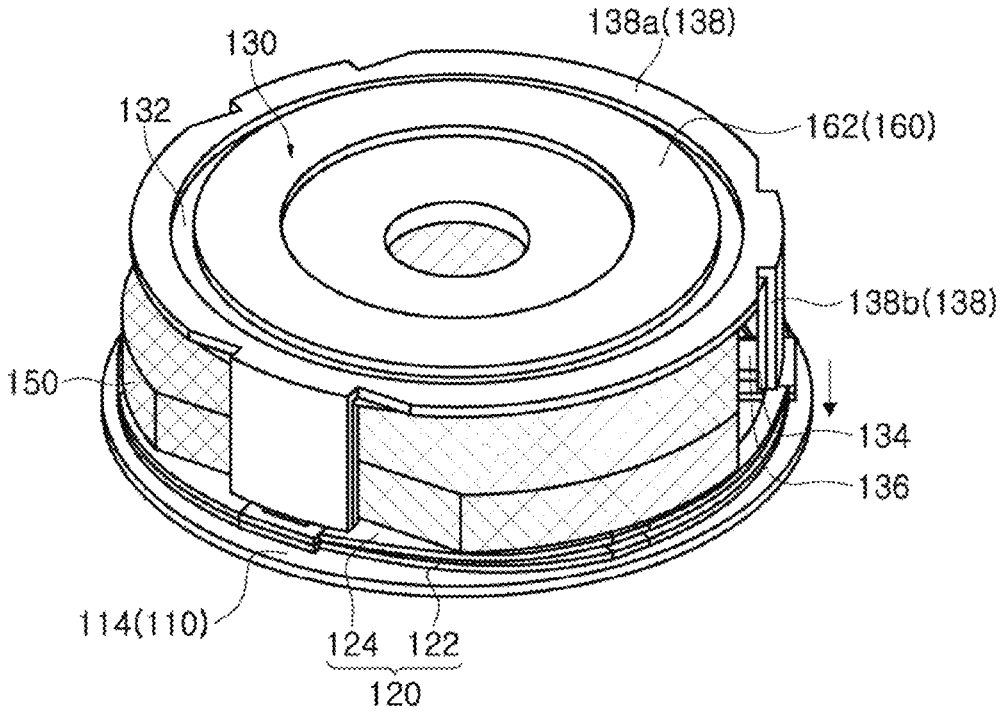

FIG. 6 is a view illustrating an operation by an installation member and the elastic member of the vibrator according to an exemplary embodiment of the present disclosure and FIGS. 7 and 8 are views illustrating an operation of the vibrator according to an exemplary embodiment of the present disclosure.

Referring to FIGS. 6 through 8, first, in the case in which power is applied to the piezoelectric element 140, the central portion of the piezoelectric element 140 may be deformed to become concave or convex. In other words, in the case in which the power is applied to the piezoelectric element 140, an edge side of the piezoelectric element 140 may be deformed upwardly, relatively with respect to a level of the central portion thereof and may be then deformed downwardly, repeatedly. For example, the edge of the piezoelectric element 140 may be vertically moved, based on the central portion.

Therefore, the installation member 130 on which the piezoelectric element 140 is fixedly installed may also be deformed in the same way as that of the piezoelectric element 140. For example, the plate portion 132 of the installation member 130 may also be deformed in the same way as the piezoelectric element 140.

As such, the lower end portion of the displacement direction changing part 134 may be repeatedly deformed inwardly and outwardly in the radial direction by the deformation of the plate portion 132 of the installation member 130.

Therefore, the central portions of the elastic members 120 may be disposed to be adjacent to each other and may be then vibrated to be spaced apart from each other.

In other words, portions of the outer ring portions 122*a* and 124*a* not bonded to each other, for example, portions not having bonding portions 122*d* and 124*d*, may be vertically vibrated, and portions of the outer ring portions 122*a* and 124*a* in which the bonding portions 122*d* and 124*d* are formed may be kept in the fixed state.

Therefore, vibrations may be generated due to deformation of the piezoelectric element 140, and further, an amount of vibration may be increased within a single space.

As described above, since vibrations may be amplified by the plurality of elastic members 120, for example, the first and second elastic members 122 and 124, a vibration amount may be increased.

In addition, since the piezoelectric element 140 is configured as an oscillator which is vibrated together with the installation member 130, the elastic member 120 and the installation member 130 may absorb an impact applied externally at the time of occurrence of external impacts. Therefore, the damage to the piezoelectric element 140 may be reduced.

As set forth above, according to exemplary embodiments of the present disclosure, an amount of vibration may be increased by the first and second elastic members.

While exemplary embodiments have been shown and described above, it will be apparent to those skilled in the art that modifications and variations could be made without departing from the scope of the present invention as defined by the appended claims.

What is claimed is:

1. A vibrator comprising:

a piezoelectric element deformed when power is applied thereto;

an installation member having the piezoelectric element installed thereon; and a plurality of elastic members connected to the installation member and changing a displacement direction through deformation of the installation member, wherein the plurality of elastic members are piled up one on top of another and disposed to oppose each other, and wherein the installation member includes a circular plate portion, a displacement direction changing part extended downwardly from the circular plate portion, and a fixing part extended inwardly from the displacement direction changing part in a radial direction and bonded to the plurality of elastic members.

2. The vibrator of claim 1, further comprising a housing having the plurality of elastic members installed therein and an internal space.

3. The vibrator of claim 1, further comprising a mass body installed on the plurality of elastic members to increase vibrations generated through deformation of the piezoelectric element.

4. The vibrator of claim 2, further comprising a damper member installed in at least one of the housing and the installation member to prevent the occurrence of noise and damage due to collisions.

5. The vibrator of claim 2, wherein the housing includes a case having an internal space and an open lower end portion, and a bracket coupled to the lower end portion of the case to form an enclosed space.

6. The vibrator of claim 5, wherein the plurality of elastic members include a first elastic member and a second elastic member, the first elastic member being installed on the bracket, and the second elastic member being installed on the first elastic member to generate the vibrations together with the first elastic member.

7. The vibrator of claim 1, further comprising a frequency adjusting member installed on the installation member, wherein the frequency adjusting member includes a ring-shaped body part having a ring form and bonded to a top surface of the circular plate portion, and a reinforcing, portion extended from the ring-shaped body part to correspond to a position of the displacement direction changing part.

8. A vibrator comprising:

a piezoelectric element deformed when power is applied thereto;

an installation member having the piezoelectric element installed thereon; and a plurality of elastic members connected to the installation member and changing a displacement direction through deformation of the installation member, wherein the plurality of elastic members include first and second elastic members which are piled, up one on top of another and disposed to oppose each other, and wherein each of the first and second elastic members includes:

an outer ring portion having a ring form having a wave form;

a plurality of connecting parts extended inwardly from an inner edge of the outer ring portion in a radial direction; and a bonding portion extended from an inner edge of the outer ring portion to be disposed between an inner ring portion connected to the plurality of connecting parts and, having a ring form and the connecting, parts.

9. The vibrator of claim 8, wherein the first and second elastic members are coupled to each other at the bonding portion and are disposed to be significantly spaced apart from each other at the connecting, part.

10. The vibrator of claim 8, wherein the bonding portions are formed to have an angle of 120° with respect to each other.

11. A vibrator comprising:

a housing containing an internal space;

a plurality of elastic members installed in the housing and piled up one on top of another and disposed to oppose each other;

an installation member connected to the plurality of elastic members and changing a displacement direction in conjunction with the plurality of elastic members;

a piezoelectric element fixedly installed on the installation member and deformed when power is applied thereto; and a mass body installed on the plurality of elastic members to be disposed below the piezoelectric element, wherein the installation member includes a circular plate portion, a displacement direction changing part extended downwardly from the circular plate portion, and a fixing part extended inwardly from the displacement direction changing part in a radial direction and bonded to the plurality of elastic members.

12. The vibrator of claim 11, further comprising a damper member installed in at least one of the housing and the installation member.

13. The vibrator of claim 11, wherein the housing includes a case having an internal space and an open lower end portion, and a bracket coupled to the lower end portion of the case to form an enclosed space.

14. The vibrator of claim 13, wherein the plurality of elastic members include a first elastic member and a second elastic member, the first elastic member being installed on the bracket, and the second elastic member being installed on the first elastic member to generate vibrations by the first and second elastic members.

15. The vibrator of claim 14, wherein each of the first and second elastic members includes:

an outer ring portion having a ring form having a wave form;

a plurality of, connecting parts extended inwardly from an inner edge of the outer ring portion in a radial direction; and a bonding portion extended from an inner edge of the outer ring portion to be disposed between an inner ring portion connected to the plurality of connecting parts and having a ring form and the connecting parts.

16. The vibrator of claim 15, wherein the first and second elastic members are coupled to each other at the bonding portion and are disposed to be significantly spaced apart from each other at the connecting parts.

17. The vibrator of claim 11, further comprising a frequency adjusting member installed on the installation member, wherein the frequency adjusting member includes a ring-shaped body part having a ring form and bonded to a top surface of the circular plate portion of the installation member, and a reinforcing portion extended from the ring-shaped body part to correspond to a position of the displacement direction changing part of the installation member.

* * * * *